United States Patent [19]

Lee

[11] Patent Number: 4,864,592

[45] Date of Patent: Sep. 5, 1989

[54] GOLF SCORE COUNTER

[76] Inventor: Yong K. Lee, 3382 Brower Ave., Mountain View, Calif. 94040

[21] Appl. No.: 177,129

[22] Filed: Apr. 4, 1988

[51] Int. Cl.[4] ..... G06F 15/44; A63B 71/06

[52] U.S. Cl. ..... 377/5; 364/411; 364/709.02; 364/709.12; 377/112

[58] Field of Search ..... 364/410, 411, 709.10, 364/709.12, 709.02; 377/5, 24.2, 112

[56] References Cited

U.S. PATENT DOCUMENTS

| | | | |
|---|---|---|---|
| 3,665,494 | 5/1972 | Baumoel | 377/5 |
| 3,829,664 | 8/1974 | Kashio | 377/5 |
| 4,220,992 | 9/1980 | Blood et al. | 364/410 |
| 4,286,323 | 8/1981 | Meday | 377/5 |

*Primary Examiner*—John S. Heyman
*Attorney, Agent, or Firm*—Linval B. Castle

[57] ABSTRACT

An electronic golf score counter for counting each fairway and putting stroke and totaling hole scores, total scores for the front nine holes, totals for the second or back nine, and the 18-hole totals. The counter has LCD displays and a plurality of switch keys for entering and displaying the hole number, its par value, the tee and fairway and putting strokes for each hole, and their totals. A reverse feature permits a count-down to a selected hole for a review of correction of a score. One embodiment provides a count for four players and includes an over/under par display for each.

13 Claims, 1 Drawing Sheet

GOLF SCORE COUNTER

BRIEF SUMMARY OF THE INVENTION

This invention relates generally to manual input electronic counters and particularly to a novel gold score counter which, in response to the pressing of appropriate keys, displays the hole number and its par value, fairway and putting strokes, their totals, and further includes a reverse or count-down toggle for reviewing previous entries or making corrections.

The small battery driven electronics involved in the golf score counter are very simple and the entire counter may be readily miniaturized and packaged to be worn on an individual player's wrist or to be carried in a shirt breast pocket. The counter may include a time of day display, if desired.

An alternate embodiment displays hole number and its par value, the individual strokes and their totals for each of a plurality of players up to a foursome and, in addition, displays time of day. This embodiment also includes the reverse or count-down toggle feature and can also display the number of strokes over or under par.

An advantage of the golf score counter is that after each shot by a player, the appropriate tee and fairway or putt key is depressed once to add to, and to display the total fairway and putt strokes for that hole. An additional key is depressed to set and display the par of each hole.

A first depression of a "total" key will display the totals of strokes and pars through the hole number displayed on the counter. A second depression of the "total" key will display the total fairway and putting strokes and total par for the "front" nine holes and a front nine symbol is displayed. The next pressing of the "total" key will indicate the second nine hole totals with a "back" symbol indicated, and the next pressing shows the total score and total par with a "final" symbol displayed.

An over/under key, labeled "OV/UN", may be depressed to display a number of strokes over par or under par. This key functions in a manner similar to the "total" key in that a first depression indicates the difference between par and the total through the hole just completed; the second depressing displays the difference for the front nine holes, the third for the second or back nine holes, and a fourth depressing displays the difference between the course par and the final score. A difference that is under par is displayed by an illuminated "minus" sign preceeding the numeric display.

A "reverse" key reverse the counting mode so that the counter counts holes, pars, strokes and putts backward to thus gives the player the opportunity to correct key entry errors and to review those previous holes of interest.

The counter is a valuable asset to tournament players who must accurately verify and sign their score cards upon completion of their game. A feature of both embodiments is a tone generator which emits a distinguishing tone or series of beeps to warm the scorekeeper that certain functions have been selected or that a predetermined number of stroke have been reached.

BRIEF DESCRIPTION OF THE DRAWINGS

In the drawings which illustrate preferred embodiments of the invention.

DETAILED DESCRIPTION

Figure 1:
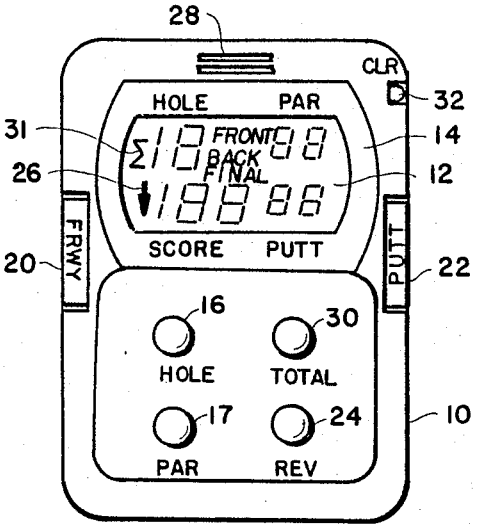
FIG. 1 is a face view illustrating a single player golf score counter.

Illustrated in FIG. 1 is a single player golf score counter in accordance with the invention. The counter includes a small housing or case 10 which may be miniaturized so that it may be strapped on the wrist of the player or his caddie and includes a display screen 12 within a bezel 14 having the labels, "HOLE", "PAR", "SCORE", and "PUTT" adjacent the position of liquid crystal display (LCD) numerals appearing on the display.

The two digit LCD numeral displayed below the label, "HOLE" on the bezel 14, HOLE Display, indicates the number of any particular hole that is manually entered into the counter by depressing a momentary contact switch, the HOLE Key 16, on the face of the counter. Each depression of the HOLE key will advance the HOLE Display by one (1) up through eighteen (18); the next pressing of the key will advance the HOLE Display to one (1).

The two-digit LCD numeral displayed below the label "PAR" on the bezel 14, PAR Display, is similarly advanced manually by depressing a momentary contact switch, PAR Key 17, on the face of the counter. The lowest number indicated by the LCD 7-segment display is the numeral "3" to represent a 3-par hole. Each subsequent depression of the PAR Key 17 advances the PAR Display by one (1) up through the numeral "5" to indicate a 5-par hole; the next depressing returns the numeral to "3". As will later be discussed, the depression of TOTAL Key will indicate a total par value.

The three-digit numeral displayed above the label "SCORE" on the bezel 14, SCORE Display, represents the sum of tee and fairway strokes and also putting strokes for the particular hole number being displayed. This numeral is advanced by one (1) for each depression of the momentary contact switches, FRWY (Fairway) Key 20 and PUTT Key 22, conveniently positioned in the side walls of the counter housing 10. While one depression of the PUTT Key advances the SCORE Display by one (1), it also advances the two-digit LCD numeral, PUTT Display, above the label "PUTT" on the bezel 14. As discussed later, the depression of the TOTAL Key 30 will display the total of all strokes and the separate total of all putts.

As previously mentioned, one feature of the invention is that the circuitry includes a tone generator for alarming the scorekeeper with unique tones or beeps to certain functions and limitations. The counter thus limits the number of fairway strokes and putts to some predetermined value, for example, a maximum of twelve fairway strokes and six putting strokes, and an attempt to exceed these maximum numbers will result in a unique alarm tone.

The depression of a momentary contact switch, REV (Reverse) Key 24 on the counter, toggles the counter so that it counts down one display unit upon each depression of the "HOLE", "PAR", "FRWY", and "PUTT" Keys. When REV Key is toggled a count-down symbol, illustrated as the downward pointing arrow 26, is displayed and a unique warning tone is sounded through an opening 28 in the counter housing 10. The tone will continue until the REV Key is retoggled into a count-up mode. With the REV Key toggled for a count-down mode, the depression of the HOLE Key will subtract one (1) from the HOLE Display down to the numeral, "1". The next depressing of the HOLE Key will display the numeral eighteen (18). The depressing the PAR Key will reduce a PAR Display, "5" to a "4", a "4" to a "3", or a "3" to a "5"; the depression of the FRWY Key will similarly reduce the SCORE Display down one stroke; and depressing the PUTT Key will reduce both the SCORE Display and PUTT Display by one stroke. Thus, the REV Key may be used for correcting a score incorrectly entered. In the count-down mode, the depressing of the REV Key returns the counter to the normal count-up mode and the displayed arrow 26 disappears from the display.

A momentary contact switch, the TOTAL Key 30, provides the totals of PAR, SCORE, and PUTT and depressing this key will display these totals up through the current hole and a "sum" symbol represented by the Greek letter, Sigma, 31 is displayed. A second depressing of the TOTAL Key displays the total for the front nine holes (1 through 9) while the HOLE Display is blanked and the symbol "FRONT" is displayed on the counter. A third depressing of the TOTAL Key displays the totals for the second nine holes (10 through 18) while the HOLE Display is blanked and the symbol "BACK" is displayed. A fourth depressing of the TOTAL Key displays the final total for all eighteen holes while the HOLE Display is blanked and the symbol "FINAL" is displayed. To return the display back to the normal display of the current hole, it is only necessary to again depress the TOTAL Key 30. A depressing of any other key except the REV Key during a TOTAL operation executes its normal functions defined on the key and returns the display back to normal.

Recessed in the side of the counter housing 10 so that it cannot be accidentally depressed is the CLR (Clear) Key 32. This key is depressed only at the beginning of a game to clear the SCORE and PUTT Displays to zero, the HOLE Display to "1", the PAR Display to "3", and to set the counter into a count-up mode. Upon depressing the CLR Key, a different and unique tone is generated.

Figure 2:
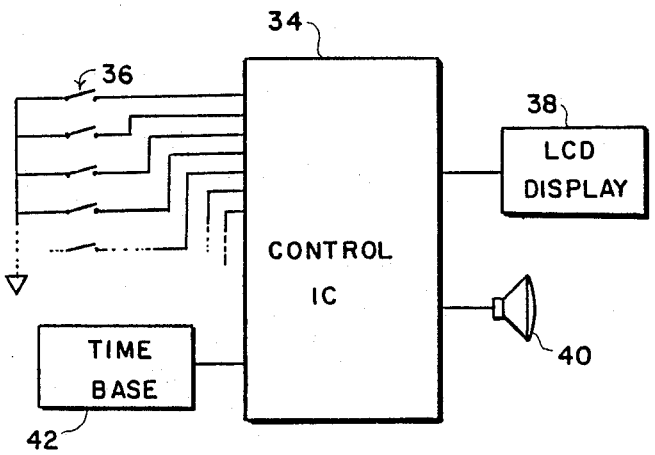
FIG. 2 is a schematic block diagram of the circuitry of the counter.

FIG. 2 is a block diagram illustrating the circuitry of the golf score counter. The heart of the counter is the control circuitry 34 which is a commercially available integrated circuit such as, for example, a Sharp SM531 microcontroller. This controller includes the necessary input/output circuits, LCD decoder and drivers, melody generator and driver, memory and arithmetic and control circuitry. Thus, the score counter of FIG. 1 includes circuitry which includes the controller 34, the input keys 36, the LCD output display 38, a transducer 40, and a time base 42. A DC battery,. such as a camera or wrist watch battery, is also required but is not illustrated in FIG. 2.

Figure 3:
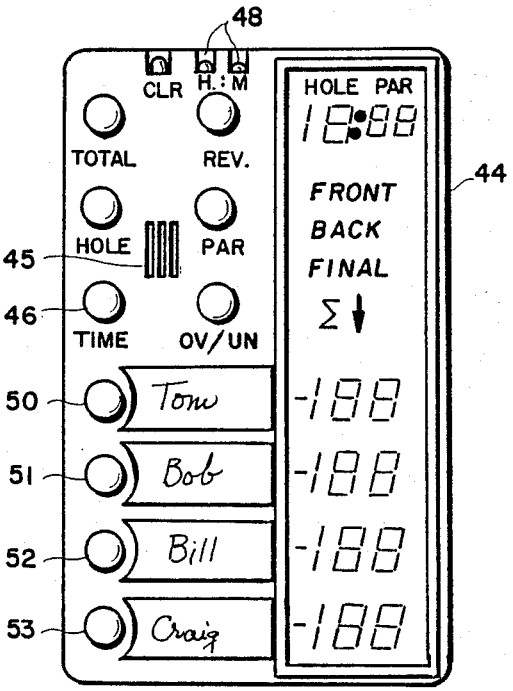
FIG. 3 is a view illustrating a multioplayer golf score counter.

FIG. 3 illustrates a second embodiment of a golf score counter operating nearly identically with that illustrated in FIG. 1 and having counting facilities for multiple players up to a foursome. The multi-player counter 44 of FIG. 3 includes momentary contact switch keys for "CLR", "HOLE", "PAR", "TOTAL" and "REV" and a sound generator behind a grill 45 in the housing, all operating similarly to those previously described in connection with FIG. 1. An additional key labelled "OV/UN" is included, the depression of which will display the difference between par and a score. Depressing the OV/UN Key operates in a manner similar to the TOTAL Key in that a first depression causes a display of the stroke difference between par and actual strokes up to the current hole, a second depressing displays the difference for the front nine holes, a third depressing displays the difference for the back nine holes, a fourth depressing displays the difference for the total eighteen holes, and a fifth depressing returns the difference counter to zero.

The HOLE Display numeral below the label "HOLE" and the PAR Display numeral below the label "PAR" are separated by a colon which is displayed along with the appropriate numerals indicating "time of day" whenever a TIME Key 46 is depressed. In this embodiment, the time base 42 in the circuitry of FIG. 2 provides the frequency required for displaying hours and minutes of the day, and the correct hour and minutes may be entered into the counter 44 by depressing the keys 48, marked "H" and "M".

The multi-player embodiment does not have a separate "PUTT" counter and all strokes including the tee shot, fairway strokes, and putting strokes for each player are entered into the counter by depressing the appropriate key 50, 51, 52, or 53. Each of these four keys, called PLAYER Keys, is matched by its own SCORE Display, a three-digit LCD numeral with a negative (−) sign. There are two different methods of entering scores via these keys. One method is similar to the combination of FRWY and PUTT Keys in the single user case (FIG. 1). In this method, a PLAYER Key depression increases or reduces its matching SCORE Display by one (1) depending on the count mode. In the second method, a first depression of the key displays the PAR value of the current hole on the matching SCORE Display and each successive depression behaves the same way as in the first method case. Thus, in this method, the number of key strokes is lessened. The SCORE Displays are used to display total scores and "over or under par value" under the TOTAL and OV/UN Key operations. To indicate "under par case", a negative sign is displayed.

Adjacent each of the PLAYER keys is an erasable good pad upon which the name of the player may be written.

The display on the multi-player counter includes, in addition to the HOLE and PAR (or Hour and Minutes) Displays and SCORE Displays, LCD displays of "FRONT", "BACK", and "FINAL" for indicating the totals up through the first nine holes, secone nine holes, and full eighteen holes, the Greek letter Sigma indicating total, and the downward pointing arrow representing count-down when the REV Key is depressed.

It is to be noted that all of the tone and alarm signals explained in connection with FIG. 1 are also incorporated into the multiplayer score counter of FIG. 3.

I claim:

1. A golfer's score counter comprising:

a housing having a face and keyboard thereon;

an electronic numeric display on said face, said display including a plurality of numerals representing a golf hole number, the par value of a golf hole, and a golf stroke score;

a plurality of switching keys on said keyboard for manually entering said golf hole number, said par value, and each stroke taken by a golfer on said golf hole number;

battery operated electron control circuitry within said housing response to the operating of said switching keys for counting the strokes taken and for generating output signale for controlling said numeric display; and a totalizing key on said keyboard, a first closure of said totalizing key causing said control circuitry to display a total current score, a second closure causing said control circuitry to display a total score through a first nine holes of plan, a third closure causing a display of a total score of a second nine holes of play, and a fourth closure causing a display of a final golf score through eighteen holes of play.

2. The golfer's scorecounter claimed in claim 1 further including additional display means on said face, said additional display means indicating the closure of said totalizing key and whether said displayed totals represent the sum of the score up to the current hole, the score of the first nine holes, the score of the second nine holes, and the final golf score through eighteen holes of play.

3. The golfer's score counter claimed in claim 2 further including a reverse key on said keyboard, said reverse key toggling said electronic control circuitry to reverse the counting mode and to cound down for each closure of the keys representing the hole number, the par value, and the golf stroke score, the toggling of said reverse key into a countdown mode causing a corresponding visible signal to appear on said display.

4. The golfer's score counter claimed in claim 3 further including a clearing key the closure of which causes said control circuitry to display a golf stroke score of "zero", a hole number of "one", and a minimum par value of "three".

5. The golfer's score counter claimed in claim 4 wherein said clearing key is recessed in said housing to prevent the accidental closure of said clearing key.

6. The golfer's score counter claimed in claim 4 further including a tone generator controlled by said electronic control circuitry and positioned to radiate its sound through openings in said housing, said control circuitry causing said tone generator to produce audible signals whenever a golf stroke score becomes "zero" during a count-down mode and whenever said score reached a predetermined maximum count capacity during a normal count-up mode.

7. The golfer's score counter claimed in claim 6 wherein said tone generator emits further audible signals when the counter is "cleared" by a "CLR" button.

8. The golfer's score counter claimed in claim 6 further including first and second switch keys representing putting strokes and fairway strokes, each of said first and second switch keys associated with a numeric display representing putting strokes and a golf stroke score each closure of said fairway stroke key during a normal count-up mode adding to the display of said golf stroke score and each closure of said putting stroke key during a normal count-up mode causing said control circuitry to advance the putting numeric display and also the golf stroke display.

9. The golfer's score counter claimed in claim 6 wherein said counter includes switch keys and golf score numeric displays for a plurality of golfers.

10. The golfer's score counter claimed in claim 9 wherein said counter includesa player key for each of said plurality of golfers, and each depression of said player key advances or reduces the displayed score for a player by one stroke.

11. The golfer's score counter claimed in claim 10 wherein a first depression of a player key displays the par value of a current golf hole and each subsequent depression advances or reduces the displayed score by one stroke.

12. The golfer's score counter claimed in claim 9 further including a switch key and means for displaying the difference between par and a golfer's score.

13. The golfer's score counter claimed in claim 9 further including an erasable name pad adjacent each switch key representing each of said plurality of golfers.

* * * * *